US007588656B2

(12) United States Patent
Weed et al.

(10) Patent No.: US 7,588,656 B2
(45) Date of Patent: Sep. 15, 2009

(54) THERMAL TRANSFER IMAGING ELEMENT AND METHOD OF USING SAME

(75) Inventors: Gregory Charles Weed, Towanda, PA (US); Richard Albert Coveleskie, Sayre, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 491 days.

(21) Appl. No.: 11/506,103

(22) Filed: Aug. 17, 2006

(65) Prior Publication Data

US 2008/0044602 A1 Feb. 21, 2008

(51) Int. Cl.
*B41M 5/42* (2006.01)
*B41M 5/46* (2006.01)

(52) U.S. Cl. ..... 156/235; 359/885; 428/32.77; 428/32.78; 428/32.79; 428/32.81

(58) Field of Classification Search ..... None
See application file for complete search history.

(56) References Cited

U.S. PATENT DOCUMENTS 5,171,650 A 12/1992 Ellis et al.
5,459,017 A 10/1995 Topel, Jr. et al.
5,523,192 A 6/1996 Blanchet-Fincher
5,534,383 A 7/1996 Takahashi et al.
5,725,989 A 3/1998 Chang et al.
5,766,819 A 6/1998 Blanchet-Fincher
5,998,085 A 12/1999 Isberg et al.
6,140,009 A 10/2000 Wolk et al.
6,228,543 B1 5/2001 Mizuno et al.
6,242,140 B1 6/2001 Kwon et al.
6,461,793 B2 10/2002 Chang et al.
6,664,020 B1 12/2003 Warner et al.
6,682,862 B1 1/2004 Chang et al.
7,408,192 B2 * 8/2008 Kang ..... 257/59

FOREIGN PATENT DOCUMENTS

EP 0 536 913 A 4/1993

OTHER PUBLICATIONS

JP 61 162387 A (Alps Electric Co Ltd) Jul. 23, 1986 Abstract.
JP 60 049998 A (Fujitsu Ltd) Mar. 19, 1985 Abstract.

* cited by examiner

*Primary Examiner*—Bruce H Hess
(74) *Attorney, Agent, or Firm*—Thomas H. Magee

(57) ABSTRACT

The present invention pertains to a donor element comprising a support layer, a transfer layer supported by the support layer, and a second layer disposed between the support layer and the transfer layer, wherein the second layer contains a binder and optionally an uncured crosslinking agent, but substantially no pigment. The binder in the second layer has a molecular weight $M_n$ that causes the second layer to be substantially transferred with the transfer layer when the donor element is exposed to light.

41 Claims, 2 Drawing Sheets

THERMAL TRANSFER IMAGING ELEMENT AND METHOD OF USING SAME

FIELD OF THE INVENTION

The present invention pertains to thermal transfer elements and methods of using the same, as well as articles formed by such methods.

BACKGROUND OF THE INVENTION

Color filters may be used in a variety of applications such as, for example, liquid crystal displays (LCDs). These color filters can be prepared using various methods of thermal mass transfer imaging using a laser beam to irradiate a donor element optionally containing a light-to-heat conversion layer, thereby effectuating a transfer of the appropriate layer onto a substrate (e.g. U.S. Pat. No. 6,242,140 Kwon et al., U.S. Pat. No. 6,682,862 Chang, et al., all incorporated herein by reference).

Typical methods of thermal mass transfer imaging are imperfect, in that, when the transfer layer is transferred from the donor element to the receiver element, a portion of the transfer layer may fail to be transferred and remains as a part of the donor element, or in that a portion of the light-to-heat conversion (LTHC) layer transfers with the transfer layer, contaminating the imaged transfer layer.

Interlayers are a proposed solution. A optional non-transferable interlayer adjacent to the optional LTHC layer is disclosed in U.S. Pat. No. 5,998,085 of Isberg, et al. Examples of interlayers are described in U.S. Pat. No. 5,725,989 incorporated herein by reference. The incorporation of an interlayer interposed between a light-to-heat conversion layer and the emissive material-containing transferable layer reduces the level of contamination of the resulting transferred image from the light-to-heat conversion layer and decreases the amount of distortion resultant in the transferred image. The interlayer may be either an organic or inorganic material. To minimize damage and contamination of the resultant transferred emissive-containing image, the interlayer preferably is a continuous coating which has a high thermal resistance and remains substantially intact and in contact with the LTHC layer during the imaging process. Suitable organic materials include both thermoset (crosslinked) and thermoplastic materials.

U.S. Pat. No. 6,461,793 Chang et al. to 3M Innovative Properties Company (the '793 patent) relates to a thermal transfer element comprising a substrate having deposited thereon (a) a light-to-heat conversion layer, (b) an interlayer, and (c) a thermal transfer layer. The thermal transfer layer may additionally comprise crosslinkable materials.

The '793 patent also provides a method for generating an image on a receptor using the above described thermal transfer element. An image is transferred onto a receptor by (a) placing in intimate contact a receptor and the thermal transfer element described above, (b) exposing the thermal transfer element in an imagewise pattern with a radiation source, and (c) transferring the thermal transfer layer corresponding to the imagewise pattern to the receptor, with insignificant or no transfer of the light-to-heat conversion layer. When the thermal transfer layer contains crosslinkable materials, an additional curing step may be performed where the transferred image is subsequently crosslinked by exposure to heat or radiation, or treatment with chemical curatives.

U.S. Pat. No. 6,228,543 Mizuno et al. to 3M Innovative Properties Company, relates to thermal transfer elements and methods of transferring layers from the thermal transfer elements, as well as the articles formed by these methods. An optional interlayer can be used in the thermal transfer element to minimize damage and contamination of the transferred portion of the transfer unit and/or reduce distortion in the transferred portion of the transfer unit. The interlayer may also influence the adhesion of the transfer layer to the rest of the thermal transfer element. The interlayer typically remains in contact with the LTHC layer during the transfer process and is not substantially transferred with the transfer unit. Suitable interlayers include, for example, polymer films, metal layers (e.g., vapor deposited metal layers), inorganic layers (e.g., sol-gel deposited layers and vapor deposited layers of inorganic oxides (e.g., silica, titania, and other metal oxides)), and organic/inorganic composite layers. Organic materials suitable as interlayer materials include both thermoset and thermoplastic materials. Suitable thermoset materials include resins that may be crosslinked by heat, radiation, or chemical treatment including, but not limited to, crosslinked or crosslinkable polyacrylates, polymethacrylates, polyesters, epoxies, and polyurethanes. The thermoset materials may be coated onto the LTHC layer as, for example, thermoplastic precursors and subsequently crosslinked to form a crosslinked interlayer.

Some imaging processes result in the incomplete transfer of the entirety of the transfer layer, thereby leaving the portion of the transfer layer deposited onto the receiver element with a rough surface, e.g., a surface having a high root mean square roughness $R_q$ value.

SUMMARY OF THE INVENTION

The present invention pertains to a donor element comprising a support layer, a transfer layer supported by the support layer, and a second layer disposed between the support layer and the transfer layer, wherein the second layer contains a binder and optionally an uncured crosslinking agent, but substantially no pigment. The binder in the second layer has a molecular weight $M_n$ that causes the second layer to be substantially transferred with the transfer layer when the donor element is exposed to light.

Another embodiment of the present invention pertains to an imaged assemblage that includes a receiver element supporting an imaged pattern of a thermally transferred multi-layer comprising an outer second layer containing a binder but substantially no pigment, and pigment-containing transfer layer between the second layer and the receiver element. In a further embodiment, the pigment-containing transfer layer comprises the binder of the second layer.

Another embodiment of the present invention pertains to a multi-imaged assemblage having a first pattern of a thermally transferred multi-layer disposed on a receiver element and a second pattern of a different thermally transferred multi-layer disposed on the receiver element, wherein the height of the first pattern is substantially similar to the height of the second pattern.

Another embodiment of the present invention pertains to a color filter comprising the entire thickness of a pattern of transfer layer and a portion of the thickness of a second different layer co-deposited thereon.

Another embodiment of the present invention pertains to a display having an electrically conductive layer in contact with a transferred multi-layer from the donor element described herein.

Another embodiment of the present invention contemplates a method of imaging comprising forming an imageable assemblage comprising embodiments of the donor element and receiving element, where the imageable assemblage is irradiated after the donor and receiver elements are appropriately positioned, and subsequent to irradiating, the donor element and the receiving element are separated, resulting in the imaged receiver element or multi-imaged receiver element embodiments described above.

BRIEF DESCRIPTION OF THE DRAWINGS

In the drawings, the reference numerals designate corresponding parts throughout the several views.

DETAILED DESCRIPTION OF THE PREFERRED EMBODIMENT(S)

The present invention may be used in forming color filters for use in a variety of applications such as, for example, a liquid crystal display or other display having an electrically conductive layer in contact with a donor element as described herein. Where a range of numerical values is recited herein, unless otherwise stated, the range is intended to include the endpoints thereof, and all integers and fractions within the range. It is not intended that the scope of the various embodiments of the invention be limited to the specific values recited when defining a range. Moreover, all ranges set forth herein are intended to include not only the particular ranges specifically described, but also any combination of values therein, including the minimum and maximum values recited.

Figure 1:
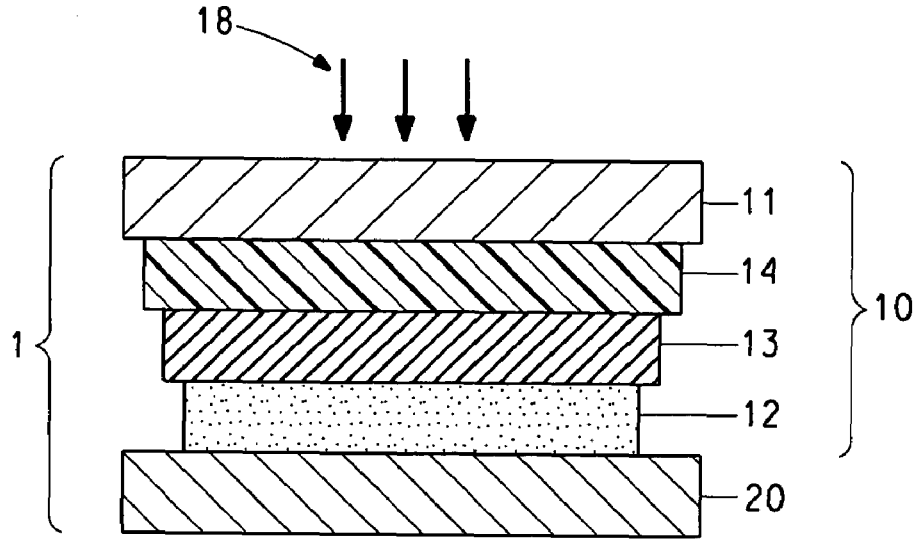
FIG. 1 shows a side view of an embodiment of an image assemblage.

FIG. 1 shows one embodiment of the present invention depicting a donor element (10) for use in a thermal transfer process comprising:

(a) a support layer (11);

(b) a transfer layer (12) supported by the support layer (11), where the transfer layer (12) comprises a pigment and is capable of being image-wise transferred from the support layer (11) to a receiver element (20) when the donor element (10) is image-wise exposed to light (18); and (c) a second layer (13) disposed between the support layer (11) and the transfer layer (12), the second layer (13) comprising a binder and an uncured crosslinking agent (where the crosslinker remains uncrosslinked (e.g. a pre-annealed crosslinking agent) until after imaging) but substantially no pigment;

wherein the binder in the second layer (13) has a molecular weight $M_n$ that causes the second layer (13) to be substantially transferred with the transfer layer (12) when the donor element (10) is exposed to light.

In the context of this invention, "substantially no pigment", "substantially devoid of pigment", and the like refers to less than 5% by weight of pigment. Utility is found for even smaller maximum amounts of pigment, for example less than 4%, 3%, 2%, and 1% by weight of pigment.

In the context of this invention, a "substantially transferred" second layer refers to transfer of more than 50% of the second layer by at least one of measure of volume and mass of the second layer. For example, typically donor elements are built up layer by layer by coating techniques such as repetition of coating and drying steps for solvent or water diluted formulations of the layers applied to the support layer. Thickness and weight measurements during donor element manufacture and before and after imaging reveal the total volume and mass transferred; after transfer and measurement of the amount of material transferred, the subtraction of the volume and mass of the more uppermost layers such as the transfer layer reveals the maximum thickness and mass of the second layer that is transferred. It is even possible to transfer all of the transfer layer and second layer and a portion of underlying layers. Other suitable ranges of transfer are more than 60, 70, 80, or 90% of the second layer.

Another embodiment of the present invention contemplates the above-described donor element (10) further comprising:

(d) a light-to-heat conversion layer (14) disposed between the support layer (11) and the transfer layer (12) as shown in FIG. 1, where the light-to-heat conversion layer (14) contains a light absorber.

In some embodiments of the present invention the light-to-heat conversion layer (14) is unnecessary since the light absorber may be incorporated and dispersed throughout at least one of layers (a) through (c).

The support layer (11) of the donor element (10) may be any suitable self-supporting film or sheet known in the art such as, for example, a film or sheet capable of self support in the absence of another supporting base. Typical support layer ingredients (11) include, but are not limited to, a polyester polymer (e.g. made from a synthetic linear polyester). The support layer (11) may be formed by those conventional techniques well-known in the art such as, for example, extrusion.

The synthetic linear polyesters may be obtained by condensing one or more dicarboxylic acids or their lower alkyl (up to 6 carbon atoms) diesters (e.g. terephthalic acid, dimethyl terephthalate diester, isophthalic acid, phthalic acid, 2,5-, 2,6-, or 2,7-naphthalenedicarboxylic acid, succinic acid, sebacic acid, adipic acid, azelaic acid, 4,4'-diphenyldicarboxylic acid, hexahydro-terephthalic acid or 1,2-bis-p-carboxyphenoxyethane (optionally with a monocarboxylic acid, such a pivalic acid) with one or more glycols, particularly an aliphatic or cycloaliphatic glycol (e.g. ethylene glycol, 1,3-propanediol, 1,4-butanediol, neopentyl glycol and 1,4-cyclohexanedimethanol)). Aromatic dicarboxylic acids such as terephthalic acid and aliphatic glycols such as ethylene glycol are preferred. Additionally, polyesters or copolyesters containing units derived from hydroxycarboxylic acid monomers, such as w-hydroxyalkanoic acids (typically $C_3$-$C_{12}$) such as hydroxyproponic acid, hydroxybutyric acid, p-hydroxybenzoic acid, m-hydroxybenzoic acid, or 2-hydroxynapthalene-6-carboxylic acid, may also be used.

Non-limiting examples of suitable commercially available support layers include, Melinex® 573, Melinex® 6442, Melinex® LJX111, Melinex® and Melinex® 453 polyester (polyethylene terephthalate) films (all available from DuPont Teijin Films, Wilmington Del.).

The support layer (11) typically has a thickness ranging from about 20 to about 200 microns, preferably ranging from about 25 to about 100 microns, and more preferably ranging from about 50 to about 100 microns. However, it is noted that support layers (11) having a thickness that is greater than or less than the thicknesses described above may also be utilized in conjunction with the present invention. Preferably, the support layer (11) is flat and has a consistent or uniform thickness so that subsequent layers deposited thereon may also be uniform. Preferably, the support layer (11) should not degrade or become deformed during normal use in the various thermal imaging processes. Irradiation of the donor element (10) may occur through the support layer (11).

Typically, the transfer layer (12) is positioned as the outermost layer of the donor element (10). The composition of the transfer layer (12) is known to those skilled in the art and varies depending upon the application for which it is intended. Preferably, the transfer layer (12) includes a binder comprising polymer(s), thermoplastic material(s), thermoset material(s) or a combination of such materials. The transfer layer (12) can be transferred in its entirety or only in selected portions as desired for particular application.

Typically, the transfer layer (12) comprises a binder, preferably a binder resin or binder polymer, wherein such resins may be polymeric, or oligomeric as well as polymerizable or crosslinkable. Suitable binders for use in forming the transferable layer include, but are not limited to, film-forming polymers such as, for example, phenolic resins, polyvinyl butyral resins, polyvinyl acetates, polyvinyl acetals, polyvinylidene chlorides, cellulosic ethers and esters, nitrocelluloses, acrylate polymers and copolymers, and methacrylate polymers and copolymers, epoxy resins, ethylenic-unsaturated resins, polyesters, polysulphones, polyimides, polyamides, polysulphides, and polycarbonates. The polymer molecular weight can be high or low; the polymers may be oligomeric.

Typically, the transfer layer (12) also contains a pigment as well optional additives known in the art such as, for example, dyes (e.g. IR dyes or NIR dyes), dispersants, surfactants, stabilizers, crosslinking agents, plasticizers, IR absorbers, polarizers, liquid crystal materials, magnetic particles, insulating particles, conductive particles, spacers for liquid crystal displays, emissive particles such as phosphors and/or electroluminescent materials, hydrophobic materials such as partition banks for ink jet receptors, hydrophilic materials, microstructured or nanostructured layers, photoresist, metals, polymers containing layers, adhesives, binders, enzymes or other bio-materials, or other suitable material known in the art as well as suitable combinations of materials. The optional additives are present in those amounts known in the art such as, for example, surfactants may be present in amounts ranging from about 0.5% to about 2% based on the total solids of the layer, near-IR dye in amounts ranging from about 0.5% to about 5%, and crosslinking agents in amounts ranging from about 4% to about 25% based on the total solids of the layer.

Non-limiting examples of suitable pigments for use in the transfer layer (12) of the embodiments of the present invention include carbon black, graphite, pigment violet 7, pigment blue 15:6, pigment violet 23, pigment red 254, pigment yellow 83 and 180 and pigment green 36. Pigments are typically present in those amounts well known in the art for particular pigments (i.e. according to color), generally ranging from about 10% to about 50% based on the total solids contained in the transfer layer (12) such as, for example blue pigment being present in an amount of 20% of solids and red in an amount of about 45% of solids. Typically, suitable thicknesses of the transfer layer (12) are those that are well known in the art. Preferably, the transfer layer (12) has a thickness of up to about 2 microns, preferably ranging from about 0.5 microns to about 1.6 microns, and more preferably the transfer layer (12) has a thickness of about 0.6 microns.

The second layer (13) of the imageable donor element (10) is typically disposed between the support layer (11) and the transfer layer (12) and can comprise a binder of the same type used to form the transfer layer (12). However unlike the transfer layer (12), the secondary layer is preferably substantially devoid of pigment (having only trace amounts) and more preferably contains no pigment. Alternatively, the second layer (13) may be a bi-pigmented layer, wherein it comprises at least two layers such that a first sublayer may contain an amount of pigment while a second sublayer is devoid of pigment.

The second layer (13) typically comprises a binder having a molecular weight $M_n$ ranging from about 1,000 to about 40,000, preferably ranging from about 1,000 to about 25,000, more preferably ranging from about 1,000 to about 15,000. The binders having the described molecular weight $M_n$ provide for the substantial transfer of the second layer (13) where upon exposure to an appropriate light source there is cohesive failure within the layer, or the second layer and the support separate. Unless otherwise specified, molecular weight refers to the number average molecular weight $M_n$, as determined by a well known means, including gel permeation chromatography versus a polystyrene standard and expressed in unified atomic mass units.

In one embodiment, the second layer is uncrosslinked but may be capable of later crosslinking due to the presense of a crosslinking agent with reactive groups and a polymer or binder having reactive groups capable of forming chemical bonds to the crosslinking agent. Some suitable pairs of reactive groups for the crosslinking reactions include: hydroxyl and isocyanate; hydroxyl and carboxyl; hydroxyl and melamine-formaldehyde; carboxyl and melamine-formaldehyde; carboxyl and amine; carboxyl and epoxy, epoxy and amine; and carboxylic anhydride and amine. The pairs of crosslinking functional groups can be utilized in several ways. One crosslinking functional group can be incorporated into the binder polymer backbone, and the other added as a polyfunctional low molecular weight crosslinking agent. One crosslinking functional group can be incorporated into the binder polymer backbone, and the other incorporated into a different binder polymer backbone. Both of the crosslinking functional groups can be incorporated into the same binder polymer backbone. The desired crosslink density of the final object dictates relative amounts of the pairs of crosslinking monomers. It is preferred that crosslinking reactions be carried out after the imaging and transfer of the second layer from the donor element to the receiver element, so that a substantial portion of the second layer is transferred.

In one embodiment, the second layer (13) and the transfer layer (12) are formed using at least a portion of the same binder; thus, when irradiation occurs during the imaging process, any light scattering at the interface of the two layers is minimized and preferably eliminated by the continuous phase of each layer being close to or identical to the same refractive index value. The shared portion of the same binder in each phase could be equal to or greater than 1, 10, 30, 50, 70, or 90% by weight. For example, when the transfer layer has 35% by weight of one binder, and the second layer has 52% by weight of the same binder, then the shared amount of binder is 35% which is greater than 30% and less than 50% by weight.

In one embodiment, the transfer layer and second layer both comprise at least one substantially identical binder. When two binders are of slightly different composition, they can be termed a single substantially identical binder if their compositions vary by less than or equal to 10% by weight; being more than 90% the same. Consider the following polymers, with all compositions expressed by weight: (a) butyl methacrylate, 42%; methyl methacrylate, 40%; acrylic acid 9%, methacrylic acid, 9%; (b) butyl methacrylate, 42%; methyl methacrylate, 40%; acrylic acid 18%; (c) butyl methacrylate, 40%; methyl methacrylate, 40%; methacrylic acid, 20%; (d) butyl methacrylate, 40%; methyl methacrylate, 42%; methacrylic acid, 18%. Composition (a) has: 91% overlap with (b) and is substantially identical; 89% overlap with (c) and is not substantially identical; and 89% overlap with (d) and is not substantially identical. Composition (b) has: 80% overlap with (c) and is not substantially identical, while composition (c) has 98% overlap with (d) and they are substantially identical.

Typically, suitable thicknesses of the second layer (13) are those that are well known in the art for layers in a donor element. Preferably, the second layer (13) has a thickness of up to about 4 microns, and more preferably a thickness of about 1 micron.

The crosslinking agent contained in the second layer (13) preferably remains uncrosslinked (a.k.a. an uncured or pre-annealed crosslinking agent) until after imaging. Providing for the crosslinking agents to be crosslinked only after imaging allows for cleavage of the second layer (13), where at least a portion of the second layer (13) (preferably a substantial portion) may be transferred to the receiving element along with the transfer layer (12), thereby building durability into the image.

The crosslinking agents suitable for use in the embodiments of the present invention include those that are known to those skilled in the art including both internal (e.g. where the polymer itself has covalently bonded groups suitable for performing the crosslinking function) and external crosslinking agents (e.g. where such agents are added into a method or process with the polymer). For example, suitable crosslinking agents include, but are not limited to, polyalkylene oxides of polyalcohols (e.g. ethoxylated trimethylol propane, ethoxylated pentaerythritol, ethoxylated dipentaerythritol and other ethoxylated, polyethoxylated, propoxylated, and polypropoxylated derivatives of triols, tetraols, and higher polyols), polyacrylates (e.g. trimethylol propane triacrylate (TMPTA), pentaerythritol tetra acrylate, dipentaerthytritol penta-, hexa-acrylate) polyalkylene oxide acrylates of polyalcohols (e.g. ethoxylated trimethylol propane triacrylate, ethoxylated pentaerythritol tetra acrylate, ethoxylated dipentaerythritol penta-, hexa-acrylate, acrlated dendrimers, ethoxylated bisphenol A diacrylate or dimethylacrylate) and melamine formaldehydes. Blends of these crosslinking agents may also be utilized. The acrylates may be thermally or photochemically initiated.

The crosslinking agents are preferably present in amounts ranging from about 4% to about 25% solids, based on the total solids of the layer, more preferably ranging from about 6% to about 20% and most preferably ranging from about 10% to about 15% solids, based on the total solids of the layer.

Non-limiting examples of suitable pigments for use in the second layer (13) of the embodiments of the present invention include carbon black, graphite, pigment violet 7, pigment blue 15:6, pigment violet 23, pigment red 254, pigment yellow 83 and 180 and pigment green 36. Pigments are typically present in those amounts well known in the art for particular pigments (i.e. according to color), generally ranging from about 0% to about 5% based on the total solids contained in the transfer layer (12). The optional light-to-heat conversion layer (14) is disposed between the support layer (11) and the transfer layer (12), where the light-to-heat conversion layer (14) contains a light absorber. The light absorber serves to absorb incident light that is emitted from the radiation source and converts at least a portion of the incident light into heat, thereby enabling the image transfer process.

The optional light-to-heat conversion layer (14) typically comprises a binder well-known to those skilled in the art and preferably a binder resin, wherein such resins may be polymeric, or oligomeric as well as polymerizable or crosslinkable. Suitable binders for use in forming this layer include, but are not limited to, film-forming polymers such as, for example, phenolic resins, polyvinyl butyral resins, polyvinyl acetates, polyvinyl acetals, polyvinylidene chlorides, cellulosic ethers and esters, nitrocelluloses, acrylate polymers and copolymers, and methacrylate polymers and copolymers, epoxy resins, ethylenic-unsaturated resins, polyesters, polysulphones, polyimides, polyamides, polysulphides, and polycarbonates. The polymer molecular weight can be high or low; the polymers may be oligomeric.

Typically, the optional light-to-heat conversion layer (14) contains the light absorber in amounts known to those skilled in the art such as, for example preferably ranging from about 10 wt-% to about 30 wt-% Preferably, the optional heat-to-light conversion layer (14) provides for a % transmission ranging from about 20% to about 60% (preferably about 45%) when irradiated with a wavelength of about 830 nanometers. Non-limiting examples of suitable light absorbers and the amounts of each utilized are well known in the art such as, for example, dyes, pigments, metallic compounds, metallic elements and carbon compounds.

The optional light-to-heat conversion layer (14) may also contain other additives in addition to the light absorbers, where such additives include those that are known by those skilled in the art.

Figure 2:
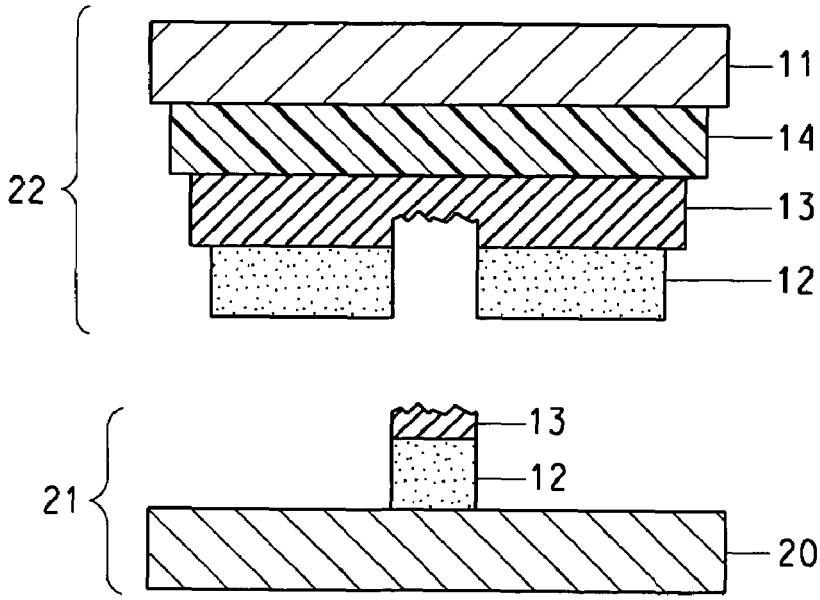
FIG. 2 shows a side view of an embodiment of an imaged donor element and an imaged receiver element, where the transfer layer is disposed on the receiver element and a portion of a second layer is disposed on the transfer layer.

FIG. 2 shows another embodiment of the present invention depicting an imaged receiver element (21) comprising:

(1) a receiving element (20);

(2) a transfer layer (12) containing a pigment, wherein the transfer layer (12) is disposed on the receiving element (20); and (3) at least a portion (and preferably a substantial portion) of a second layer (13) disposed on the transfer layer (12) wherein a multi-layered image is formed, the second layer (13) comprising a binder that is substantially devoid of pigment.

The imaged receiver element (21) is made by the separation of the imaged donor element (22) from the assemblage of FIG. 1 after imaging by a pattern of light (18). The separation is easily carried out, for example by peeling the donor element support layer (11) from the receiver element (20) after imaging by light (18).

The light used for imaging can be for example ultraviolet light, visible light, near infrared light, infrared light, or a combination of light wavelengths. A preferred form of light is laser light, due to the availability of high intensity, fast switching, narrow wavelength range, and low cost laser light sources which make them suitable for patterning of images.

Assemblages can be imaged utilizing at least two different types of thermal imaging equipment, distinguished mainly by how the assemblage is held, for example on either a drum or on a flatbed. A conventional drum type imager such as a Creo Model 3244 Spectrum Trendsetter (Kodak Graphics Communications Canada (formerly Creo), Vancouver, Canada) equipped with a 20 W laser head operating at a wavelength of 830 nm, is suitable for imaging of flexible receiver elements. Assemblages can be imaged by illuminating the support layer side of the donor element of the assemblage. Assemblages can be mounted using vacuum hold down to a standard plastic carrier plate clamped mechanically to the drum. Control of the laser output is by a computer to move at least one of the head or the drum to form the desired image pattern using the laser head. For example for a color filter, the desired three color image can be built up by sequentially imaging red, green and blue donor elements onto the same original receiver element. The exposure order for the colors can be varied according to any system requirements (e.g. optimal exposure characteristics).

Another kind of imager (the "flatbed") typically can employ an identical imaging laser head and associated control and movement means for the laser head, but the assemblage is held on a moveable flatbed format for imaging rather than the drum format. The flatbed imager is preferred for exposure of relatively rigid, flat samples such as glass. The sample to be exposed can be mounted using vacuum hold down to a translation stage positioned below the imaging head. During exposure the sample is typically translated past the imaging head at an appropriate speed, for example 1-2 m/s. Following the completion of each exposure pass, the imaging head can be translated in the direction orthogonal to the sample translation to move a new unexposed area of assemblage in front of the laser for the next imaging pass. This process can be repeated to build up the completed exposure. As in the drum imager, a desired three color image is prepared by sequentially exposing the red, blue and green donors to the same receiver element in any order desired.

Accuracy of movement of the assemblage is important. A useful flatbed positioning system can be constructed using linear air bearings constructed using appropriate linear brushless servomotors as the drive system, and a noncontact linear encoder or laser interferometer for position feedback. Resolution can typically be as precise as 0.3 nanometers to 79 nanometers for a laser interferometer, or 4 to 1000 nanometers for a non-contact linear encoder, with an overall accuracy of plus or minus one micron, repeatability to 0.4 microns, with differential straightness and flatness of 0.5 microns per 25 millimeters and maximum deviation of plus or minus 3 microns. An appropriate translation stage system is the ABL80075 manufactured by Aerotech, Inc., Pittsburgh, Pa.

In typical imaging systems, laser power and translation speed are controllable and can be tested and adjusted in an iterative fashion to optimize image quality as judged by visual or instrumental inspection of the transfer image on the receiving surface.

Typically the light absorber concentration used is matched to the light intensity used to provide the necessary heating in the assemblage. For example the light absorber might provide absorbance of at least 30% of the incident light, preferably more such as more than 50%, 60%, 70%, 80%, or 90% of the incident light used for imaging at the wavelength of highest intensity of the imaging light, in order to absorb a suitable amount of energy from the available light during the imaging step in order to cause thermal transfer.

Figure 3:
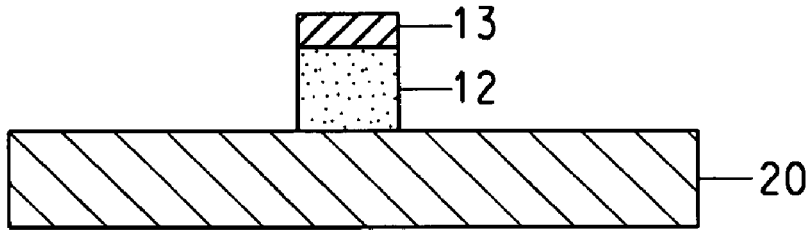
FIG. 3 shows a side view of an imaged receiver element, post-annealing, where the transfer layer is disposed on the receiver element and a portion of a second layer is disposed on the transfer layer.

In one embodiment, the imaged receiver element (21) can be heated to treat the transfer material. In one embodiment, the heating can cause flow of a rough material (termed "annealing") such as the surface of the transferred portion of second layer 13 of FIG. 2, to produce a smoother surfaced material of layer 13 as shown in FIG. 3. In another embodiment, heating can cause crosslinking of components within a layer, such as layer 12, layer 13, or both layer 12 and 13, of FIG. 3. As reactions leading to crosslinking proceed, flow is expected to decrease and eventually halt. The heating used for annealing and crosslinking can be any temperature or time found to be useful; for example temperatures expected to be useful are those greater than one of 80, 100, 140, 180, 220, and 260 C, and less than one of 90, 120, 160, 200, 260, and 300 C, and times of heating of greater than one of 1, 10, 30, and 90 minutes and 1, 3, 5, 10, and 20 hours, and less than one of 5, 20, 100, and 300 minutes and 2, 4, 8, 16, 30, and 100 hours.

Figure 4:
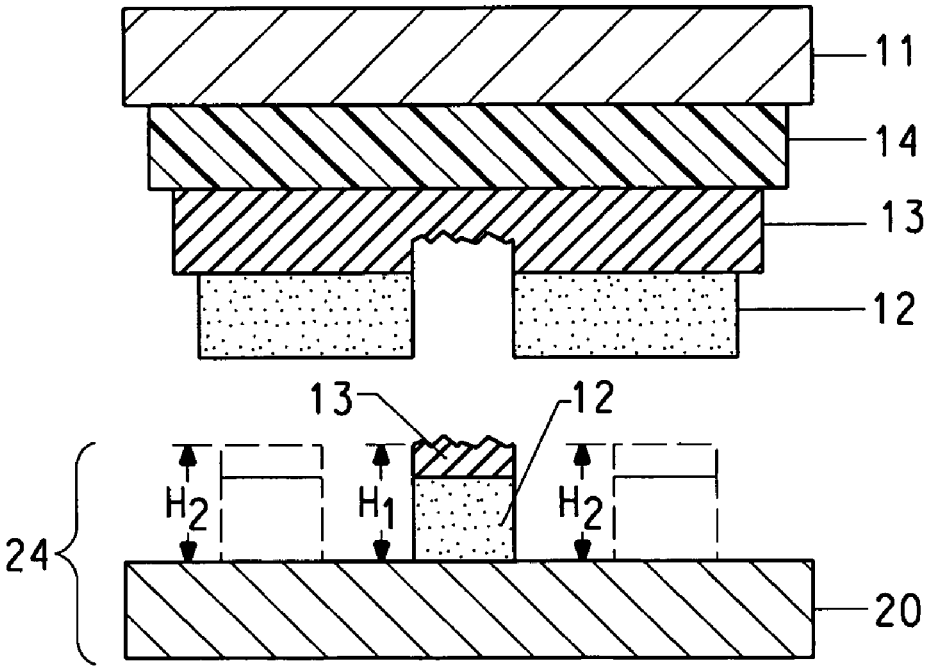
FIG. 4 shows a side view of a multi-imaged receiver element as well as an imaged donor element.

Another embodiment of the present invention contemplates an imaged receiver element that has been imaged multiple times (a multi-imaged receiver element (24) of FIG. 4, for example a color filter), such that, at least two multi-layered images (components (2) and (3) above) have been deposited thereon, wherein the height of a first multi-layered image ($H_1$) (the right and left dotted features of FIG. 4) is substantially similar to the height of at least a second multi-layered image ($H_2$) (the center feature comprising the transfer layer 12 and the second layer 13 of FIG. 4). In one embodiment, only one of the two images of similar height has a second layer; in another embodiment each image has a corresponding second layer, but the second layers need not be identical to one another.

In the context of the present invention, the height of an image on a receiver element is measured perpendicular to the surface of the receiver element that supports the image. The height of the receiver element surface under the transferred image can be taken to be equal to that linearly interpolated from the height near the two edges between the receiver element and the image. When heights are compared, such heights should be measured by the same technique. Appropriate techniques include physical height measurement, e.g. with a stylus such as a position recording stylus that is moved sequentially across the receiver element surface, across an edge of the transferred image, across a contiguous portion of the transferred image, across an edge of the same transferred image, and across the receiver element surface; or optical height measurement, e.g. by interferometric methods. Suitable instruments include a Tencor P15 Profilometer (KLA-Tencor, San Jose, Calif.) or a LaserScan LT8010 (Solarius Development, Inc, Sunnyvale, Calif.). Average heights can be used; notably mean height or median height can be used. Height comparisons should be made for heights determined within a distance of 1 cm or less of separation. When a height differential is cited as being less than a positive value, it is understood that this means that both the value and zero lie within the 90% confidence interval of the absolute difference of the two means derived from multiple measurements of the respective heights.

A typical receiver element (20) may be imaged many times, with each multi-layered image having corresponding height(s) ($H_n$), wherein the term "at least a second multi-layered image" is meant to take this aspect into account. Preferably, the heights of the first multi-layered image ($H_1$) and the at least second multi-layered image ($H_2$) (as well as the heights of any subsequent multilayered images ($H_n$)) differ (have a height differential) by less than 0.5 microns (either pre- or post-annealing), more preferably less than 0.2 microns (either pre- or post-annealing) and most preferably less than 0.1 micron (either pre- or post-annealing). Thus, in these embodiments the entirety of an area of the transfer layer (12) (with respect to its thickness) is transferred during the imaging process, where any height difference between the various transferred portions is minimized by the second layer (13) acting as a spacer and substantial height equalizer.

The receiver element (20) for use with embodiments of the present invention may be any substrate suitable for a particular application or end-use well known in the art, wherein such receiver elements (20) include, but are not limited to, both rigid and flexible substrates such as, for example glass, films (e.g. transparent films, polymer films, etc.), plastics, papers, and metals.

As shown in the FIGS., the imaged receiver element (21) comprises a portion of the transfer layer (typically across its entire thickness) as well as a portion of the second layer (13) (the multi-layered image). Surface texture characteristics with respect to its roughness are well known in the art as represented by the designation $R_q$ or rms. $R_q$ or rms designate the root-mean-square average of the measured height deviations taken within a length or area evaluated and measured from the mean linear surface. In other words, $R_q$ or rms represents the standard deviation of the profile heights. Typically, when a second layer (13) is not utilized, as the imaging power increases the $R_q$ also increases sharply to values above the acceptable range. However, with the use of the second layer (13) as the imaging power increases, the $R_q$ value increases only slightly if at all. The inclusion of a portion of the second layer (13), in addition to its height matching capabilities, allows for the surface of the multi-layered image(s) to be very smooth, where it preferably has an $R_q$ value of less than 40 nanometers, more preferably less than about 20 nanometers.

In one embodiment, an imaged receiver element of the present invention, bearing a second layer and a transfer layer disposed between the receiver element and the second layer, can be coated with a conductive layer so that the conductive layer contacts the second layer. In other previously known cases such as a color filter bearing three differently-colored imaged layers of different heights, an unimaged planarizing layer is placed over the imaged layers before a conductive layer such as indium-tin oxide is applied to the receiver element on top of the planarizing layer. In such a case, the conductive layer does not contact the imaged layers. By appropriately adjusting the second layer height of an embodiment of the present invention, the height of an imaged layer having that second layer can be increased or decreased to be appropriately close to the height of another imaged layer, eliminating the need for a planarizing layer before the application of a conductive layer contacting the second layer. Such objects can be useful as a color filter or in a display.

Ingredients in other possible conductive layers include for example those comprising aluminium doped zinc oxide, metals such as copper and silver, polymeric conductors, such as polyaniline, and organic conductors such as carbon nanotubes.

Another embodiment of the present invention contemplates a method of imaging comprising:

(i) forming an imageable assemblage comprising a combination of embodiments of a donor element (10) and receiving element described herein;

(ii) irradiating the imageable assemblage; and (iii) separating the donor element (10) and the receiving element, wherein cleavage occurs in the second layer (13) of the donor element (10).

The above-described method of imaging may further comprise:

(iv) annealing the receiving element, wherein a surface of the second layer (13) has an $R_q$ value of less than 5.

Generally, the imaging process occurs by contacting the donor element (10) with the receiving element and irradiating the donor element (10), thereby resulting in the transfer of a portion of the transfer layer (12) across its entire thickness as well as transferring a portion of the second layer (13) such that cleavage of the second layer (13) occurs within the second layer (13). The result of the embodiments of the present invention provide for the transfer of 100% of the transfer layer (12), but also for the transfer of some portion of the second layer (13). Thus, there is no loss of any portion of the functional layer during the thermal image transfer process. The use of the term "contact" refers to where in the embodiments of the present invention, (1) the various layers of embodiments of the donor element (10) and receiver element (20) are contiguous or coextensive with any adjacent layers, or (2) where there is sufficient contact between the two surfaces to effectuate the transfer of materials during the imaging process to provide a sufficient transfer of material within the thermally addressed areas, where no voids are present in the imaged areas that would render the transferred image non-functional for its intended application.

The imageable assemblage (1) may be irradiated using radiation of various wavelengths such as, for example, visible light, infrared radiation, near infrared radiation, or ultraviolet radiation. Accordingly, the radiation sources may be those well known within the art including, but not limited to, high-powered light sources such as lasers including infrared, visible and ultraviolet lasers. The assemblage may be irradiated by a large number of small, independently controlled laser beams of light (pixels) simultaneously. The assemblage can be moved relative to the beams.

EXAMPLES

The following ingredients were used:

CARBOSET® XPD-2091 (Noveon, Inc., Cleveland, Ohio) is a styrene acrylic colloidal dispersion polymer at 43% solids in water with dimethylethanol amine, with polymer weight average molecular weight of 3500, glass transition temperature of 70 C, minimum film-forming temperature of less than 10 C, and acid number of 170 mg KOH per gram polymer.

CARBOSET® GA-2300 (Noveon, Inc., Cleveland, Ohio) Acrylic colloidal dispersion polymer at 28% solids in water with ammonia, with polymer weight average molecular weight of 11,000, glass transition temperature of 70 C, minimum film-forming temperature of less than 0 C, and acid number of 200 mg KOH per gram polymer.

ZONYL® FSA is a 25% solids fluorosurfactant solution in a water iso-propanol blend, comprising $RfCH_2CH_2SCH_2CH_2CO_2Li$ where $Rf=F(CF_2CF_2)_x$ and where x is from 1 to about 9, available from E.I. du Pont de Nemours, Inc., Wilmington, Del.

SDA-4927 is 2-[2-[2-Chloro-3[2-(1,3-dihydro-1,1dimethyl-3-(4dimethyl-3(4sulfobutyl)-2H-benz[e]indol-2-ylidene)ethylidene]-1-cyclohexen-1-yl]ethenyl]-1,1-dimethyl-3-(sulfobutyl)-1H-benz[e]indolium, inner salt, free acid, an infrared dye [CAS No. 162411-28-1] available from H.W. Sands Corp., Jupiter, Fla., suitable for laser light absorbance to promote thermal mass transfer by selectively absorbing light of around 830 nm wavelength. Polyol DPP®130, also known as poly(oxy-1,2-ethanediyl), -hydro-T-hydroxy-, ether with 2,2'-(oxybis(methylene)) bis(2-hydroxymethyl)-1,3-propanediol) (6:1) (CAS No. 50977-32-7), is an ethoxylated dipentaerythritol polymer clear liquid, available from Perstorp Polyols Inc, Toledo, Ohio, that comprises a $(—CH_2)_3CCH_2OCH_2C(CH_2—)_3$ chemical structure.

Surfynol DF110D (Air Products and Chemicals, Allentown, Pa.) is a nonionic, nonsilicone, acetylenic-based, defoamer (2,5,8,14-tetramethyl-6-dodecyne-5,8-diol, CAS [68227-33-8]), at 32% active solids in dipropylene glycol.

Blue Pigment Dispersion BPD is a 36% solids aqueous composition of a blue and a violet pigment at pigment to binder/dispersant ratio of 1.95:1.

Composition PL-01 was a mixture of 179.3 parts distilled water, 3.38 parts 3% aqueous ammonia, 2 parts Zonyl FSA®, 1.3 parts SDA 4927, 71.68 parts BPD, 9 parts Polyol DPP-130, 0.5 parts Surfynol DF110D, and 224.26 parts Carboset GA2300. Composition PL-02 was a mixture of 260.3 parts distilled water, 3.38 parts 3% aqueous ammonia, 2 parts Zonyl FSA®, 1.3 parts SDA 4927, 86.51 parts BPD, 9 parts Polyol DPP-130, 0.5 parts Surfynol DF110D, and 205.19 parts Carboset GA2300.

Composition IL-01 was a mixture of 1373.9 parts distilled water, 3.38 parts 3% aqueous ammonia, 2 parts Zonyl FSA®, 1.3 parts SDA 4927, 9 parts Polyol DPP-130, 0.5 parts Surfynol DF110D, and 316.41 parts Carboset GA2300.

Composition IL-02 was a mixture of 922.1 parts distilled water, 3.38 parts 3% aqueous ammonia, 2 parts Zonyl FSA®, 1.3 parts SDA 4927, 9 parts Polyol DPP-130, 0.5 parts Surfynol DF110D, and 316.41 parts Carboset GA2300.

Composition IL-03 was a mixture of 658.47 parts distilled water, 3.38 parts 3% aqueous ammonia, 2 parts Zonyl FSA®, 1.3 parts SDA 4927, 9 parts Polyol DPP-130, 0.5 parts Surfynol DF110D, and 316.41 parts Carboset GA2300.

Support layer (1) containing a light-to-heat conversion layer was provided by a clear 50 micron thick polyethylene terephthalate polyester film coated on the transfer-layer-coatable side with a thin (~200 nanometer) polymeric light-to-heat conversion layer containing a near-ir dye to obtain about 45% transmission of light at 830 nanometers wavelength.

A Tencor P-15 Stylus profilometer (KLA-Tencor, San Jose, Calif.) was used to measure the height (nm) of transferred material and determine surface roughness values that are reported as Rq (roughness quotient) in nm.

A suitable imager is the Creo Spectrum Trendsetter 3244F (CREO, Burnby, BC, Canada), which utilizes lasers emitting near 830 nm. This device utilizes a Spatial Light Modulator to split and modulate the 5-50 Watt output from the ~830 nm laser diode array. Associated optics focus this light onto the imageable elements. This produces 0.1 to 30 Watts of imaging light on the donor element, focused to an array of 50 to 240 individual beams, each with 10-200 mW of light in approximately 10×10 to 2×10 micron spots. Similar exposure can be obtained with individual lasers per spot, such as disclosed in U.S. Pat. No. 4,743,091. In this case each laser emits 50-300 mW of electrically modulated light at 780-870 nm. Other options include fiber coupled lasers emitting 500-3000 mW and each individually modulated and focused on the media. Such a laser can be obtained from Opto Power in Tucson, Ariz. Color of the transferred material was measured using an Ocean Optics diode spectrophotometer (Ocean Optics, Dunedin, Fla.).

All measurements in formulations are parts by weight unless otherwise specified.

Examples 1-5

Comparative donor element 1 (DE-PL01) was made by coating around 35 mg dry weight coating per square decimeter of transfer layer precursor PL-01 using a #11 wire-wound rod on the coated side of support layer (1) and drying the coating. Similarly comparative donor element 2 (DE-PL02) was made at around 29 mg dry weight coating per square decimeter of PL-02.

Experimental donor element 3 (DE-IL-01/PL02) was made in two stages. In stage one, the light-to-heat conversion layer-coated side of support layer (1) was coated with second layer precursor IL-01 using a #5 wire wound rod and subsequently dried to obtain a coating weight of IL-01 of about 4 mg per square decimeter. In stage two, the light-to-heat conversion layer-and second layer coated side of support layer (1) was coated with transfer layer precursor PL-02 using a #11 wire wound rod and subsequently dried to obtain a coating weight of PL-02 of about 29 mg per square decimeter.

Experimental donor element 4 (DE-IL-02/PL02) was made in two stages. In stage one, the light-to-heat conversion layer-coated side of support layer (1) was coated with second layer precursor IL-02 using a #5 wire wound rod and subsequently dried to obtain a coating weight of IL-02 of about 6 mg per square decimeter. In stage two, the light-to-heat conversion layer-and second layer coated side of support layer (1) was coated with transfer layer precursor PL-02 using a #11 wire wound rod and subsequently dried to obtain a coating weight of PL-02 of about 29 mg per square decimeter.

Experimental donor element 5 (DE-IL-03/PL02) was made in two stages. In stage one, the light-to-heat conversion layer-coated side of support layer (1) was coated with second layer precursor IL-03 using a #5 wire wound rod and subsequently dried to obtain a coating weight of IL-03 of about 8 mg per square decimeter. In stage two, the light-to-heat conversion layer-and second layer coated side of support layer (1) was coated with transfer layer precursor PL-02 using a #11 wire wound rod and subsequently dried to obtain a coating weight of PL-02 of about 29 mg per square decimeter.

The donor elements were imaged onto a sheet of glass in an assemblage using a flat bed imager. The image was a pattern of closely spaced lines about ten centimeters or more long, and 100 microns wide, separated by 200 micron spaces. The second and third imaging placed lines into the previous spaces not occupied by lines, but interleaved with the previously patterned lines, similar to imaging useful for a color filter. The imager utilized a imaging head capable of imaging 16 lines separated by spaces at one time, using diode laser light of around 830 nm wavelength, relative movement of head and assemblage at about 1.3 m/s (tested at 1.0 to 1.6 m/s at 9 separate levels), and laser energy of around 15 watts. After all imaging was complete, the separated imaged glass bearing the images was heated at 240 C for 1 hour. The imaged lines were then characterized calorimetrically and for the height of the transfer layer. The results in table 1 were obtained, were color is expressed in xyY values, Rq is root mean square roughness, Wq is root mean square waviness, lip height is the excess height obtained for transferred material near the maximum width of a feature, and step height average is the averaged height of the transferred material. Target color was x=0.1415+/−0.008, y=0.081+/−0.009, and Y=8.35+/−3. Lip height refers to the height of a raised feature or edge of the pattern that comprises transfer layer on the receiver element near the margins of the pattern imaged, expressed as the height above the average height of the pattern that comprises transfer layer.

TABLE 1

First Assemblage Imaging at ~1.5 m/s (values in nm unless noted)

| Source Donor | Color | Rq (short path) | Wq | Transferred Height (average) | Lip Height |
|---|---|---|---|---|---|
| 1 DE-PL-01 | OK | 4.7 | 45 | 1553 | 174 |
| 2 DE-PL-02 | OK | 5.0 | 131 | 964 | 463 |
| 3 DE-IL-01/PL-02 | OK | 6.3 | 59 | 1615 | 212 |
| 4 DE-IL-02/PL-02 | OK | 4.3 | 26 | 1832 | 116 |
| 5 DE-IL-03/PL-02 | OK | 1.7 | 6 | 2108 | 66 |

DE-PL-02 was formulated so that at imaging head movement speeds from 1 to 1.6 m/s, the transferred colorant layer was within the required specification. DE-PL-01, formulated in an attempt to give equivalent color in a thicker film with lower colorant concentration, was out of color specification at lower imaging head speeds (1.0, 1.075, 1.15, 1.3 m/s). All of the transferred layers from DE-IL-01/PL-02, DE-IL-02/PL-02, and DE-IL-03/PL-02 were in specification for color except DE-IL-01/PL-02 at 1.0 m/s. The use of the second layer also showed advantages in allowing changes of roughness, waviness, transferred height, and lip height without significantly changing the color value obtained or reformulating the two layers. There is a very strong relationship between the coating weight of second layer used (W, mg/dm$^2$) and the transferred height achieved (H, nm) of $$H=989.4(+/-42.4)+W*(142.3+/-7.9)$$

With the uncertainty being the standard error based upon the data for W set at 0, 4, 6 and 8. This illustrates that a selection of coating weight for the second layer can be used to achieve a height matching another transferred layer that is thicker than the transfer layer associated with the second layer. The W coefficient of 142.3 indicates that a layer of about 7 mg/dm$^2$ would increase the transferred layer height by about 1000 nm, consistent with transfer of approximately all the second layer (and possibly also increased transfer of the transfer layer).

Comparative Donor Element Examples 6-7

A second layer composition analogous to that of U.S. Pat. No. 6,228,543 Mizuno et al. table 2 col 13 was formulated at about 15% solids with 76.5 parts isopropanol, 8.50 parts methyl ethyl ketone, 0.69 parts Butvar B-98 polyvinyl butyral Mw=40-70 K, 80% butyralated, 20% hydroxylated as PVA (Solutia, Inc, St. Louis, Mo.), 2.08 parts Joncryl 67, a styrene acrylic binder copolymer with a carboxylic acid concentration of approximately 3.8 mM/gram binder and number average relative molecular mass Mw of 12,000 (Johnson Polymer, Sturtevant, Wis.), 11.57 parts SARTOMER SR351 (trimethylolpropane triacrylate, available from Sartomer, Exton, Pa.) and 0.66 parts Irgacure 369 (2-benzyl-2-dimethylamino-1-(4-morpholinophenyl)-butanone-1, CAS No. [119313-12-1], Ciba Specialty Chemicals, Tarrytown, N.Y.), and alternatively at 20% solids.

The 15% solids formulation was coated on support layer (1) using a #6 wire wound rod to obtain a second layer of about 8 mg per square decimeter of dried formulation on donor element 6 precursor. The tacky donor element 6 precursor was UV cured by about 250 mJ of light in a nitrogen atmosphere, providing a layer dry to the touch having an increased molecular weight $M_n$ due to photochemical crosslinking. Donor element 6 cured precursor was coated with transfer layer precursor PL-02 using a #11 wire wound rod and subsequently dried to obtain a coating weight of PL-02 of about 29 mg per square decimeter. The resulting donor element 6 (DE-Miz-8-PL-02) was imaged in an assemblage with a glass receiver element as previously exemplified.

Similarly the 20% solids formulation was coated with a #9 wire wound rod to obtain a second layer of about 25 mg per square decimeter of dried formulation on donor element 7 precursor. The tacky donor element 7 precursor was UV cured by about 250 mJ of light in a nitrogen atmosphere, providing a layer dry to the touch having an increased molecular weight $M_n$ due to photochemical crosslinking. Donor element 7 cured precursor was coated with transfer layer precursor PL-02 using a #11 wire wound rod and subsequently dried to obtain a coating weight of PL-02 of about 29 mg per square decimeter. The resulting donor element 7 (DE-Miz-25-PL-02) was imaged in an assemblage with a glass receiver element as previously exemplified.

Formulation IL-03 was coated on support layer (1) using a #5 wire wound rod to obtain a second layer of about 8 mg per square decimeter of dried formulation on donor element 8 precursor. Donor element 8 precursor was coated with transfer layer precursor PL-02 using a #11 wire wound rod and subsequently dried to obtain a coating weight of PL-02 of about 29 mg per square decimeter, without a previous UV curing step that would increase the molecular weight $M_n$ of the second layer. The resulting donor element 8 (DE-IL03-8-PL-02) was imaged in an assemblage with a glass receiver element as previously exemplified, using the same laser power settings and different laser movement speeds of ~1.225 m/s and ~1.15 m/s for different separate imagings of assemblages.

TABLE 2

First Assemblage Imaging at ~1.225 m/s (values in nm unless noted)

| Source Donor | Color | Rq (short path) | Wq | Transferred Height (average) | Lip Height |
|---|---|---|---|---|---|
| 6 DE-Miz-8/PL-02 | OK | 46 | 162 | 875 | 470 |
| 7 DE-Miz-25/PL-02 | OK | 23 | 189 | 468 | 658 |
| 8 DE-IL-03-8/PL-02 | OK | 18 | 19 | 2159 | 124 |

TABLE 3

Second Assemblage Imaging at ~1.15 m/s (values in nm unless noted)

| Source Donor | Color | Rq (short path) | Wq | Transferred Height (average) | Lip Height |
|---|---|---|---|---|---|
| 6 DE-Miz-8/PL-02 | OK | 13 | 118 | 957 | NA |
| 7 DE-Miz-25/PL-02 | Off | 34 | 109 | 610 | 321 |
| 8 DE-IL-03-8/PL-02 | OK | 18 | 20 | 2014 | 67 |

Comparative examples 6 and 7 clearly transfer much lower heights of material to the imaged receiver; at ~1.225 m/s of laser imaging speed, comparative donor element 6 with UV cured binder in the second layer (around 8 mg per square decimeter dry coated weight) transfers a layer with height of approximately 957 nm; while comparative donor element 7 with a thicker layer of UV cured binder in the second layer (around 25 mg per square decimeter dry coated weight) transfers a thinner layer with height of approximately 610 nanometers. Experimental example 8 was made without the UV curing step that crosslinks the second layer; by having a lower $M_n$ binder, the second layer substantially transfers and a height of transferred layer of 2014 nm is obtained.

Comparative examples 6 and 7, in contrast to comparative example 2 with no second layer (transferred height around 964 nm), show that use of an unsuitable second layer (crosslinked or otherwise of too high a molecular weight $M_n$) can decrease the amount of transfer layer arriving on the receiver element as well as having deleterious effects on roughness, and waviness. It is also notable that a thicker unsuitable second layer (comparative layer 7 having a thicker layer than comparative layer 6) actually causes the transferred height to go down and the color value to fall out of the specification.

What is claimed is:

1. A donor element for use in a thermal transfer process comprising:

(a) a support layer;

(b) a transfer layer supported by the support layer, where the transfer layer comprises a pigment and is capable of being imagewise transferred from the support layer to a receiver element when the donor element is imagewise exposed to light; and (c) a second layer disposed between the support layer and the transfer layer, the second layer comprising a crosslinking agent and a binder but substantially no pigment, the binder comprising a plurality of groups reactive with the crosslinking agent;

wherein the binder in the second layer has a molecular weight $M_n$ that causes the second layer to be substantially transferred with the transfer layer when the donor element is exposed to light.

2. The donor element according to claim 1 further comprising:

(d) a light-to-heat conversion layer disposed between the support layer and the transfer layer, the light-to-heat conversion layer comprising a light absorber.

3. The donor element according to claim 2, wherein the light-to-heat conversion layer comprises a polymer.

4. The donor element according to claim 3, wherein the polymer is selected from the group consisting of phenolic resin, polyvinyl butyral resin, polyvinyl acetate, polyvinyl acetal, polyvinylidene chloride, cellulosic ether and ester, nitrocellulose, acrylate polymer and copolymer, methacrylate polymer and copolymer, epoxy resin, ethylenic-unsaturated resin, polyester, polysulphone, polyimide, polyamide, polysulphide, polycarbonate, and copolymers and combinations thereof.

5. The donor element according to claim 2, wherein the light absorber is selected from the group consisting of dyes, pigments, metallic compounds, metallic elements, metallic oxides, carbon compounds, and combinations thereof.

6. The donor element according to claim 1, wherein at least one of layers (a), (b) and (c) comprises a light absorber.

7. The donor element according to claim 1, where the support layer comprises a polyester polymer.

8. The donor element according to claim 7, wherein the polyester polymer is selected from the group consisting of a dicarboxylic acid condensed with a glycol, a hydroxycarboxylic acid condensed with itself, and combinations thereof.

9. The donor element according to claim 7, wherein the polyester polymer comprises an aromatic dicarboxylic acid condensed with an aliphatic glycol.

10. The donor element according to claim 1, wherein the transfer layer comprises a polymer.

11. The donor element according to claim 10, wherein the polymer is selected from the group consisting of phenolic resin, polyvinyl butyral resin, polyvinyl acetate, polyvinyl acetal, polyvinylidene chloride, cellulosic ether and ester, nitrocellulose, acrylate polymer and copolymer, methacrylate polymer and copolymer, epoxy resin, ethylenic-unsaturated resin, polyester, polysulphone, polyimide, polyamide, polysulphide, polycarbonate, and combinations and copolymers thereof.

12. The donor element according to claim 1, wherein the transfer layer further comprises one or more additives selected from the group consisting of dyes, dispersants, surfactants, stabilizers, crosslinking agents, plasticizers, IR absorbers, polarizers, liquid crystal materials, magnetic particles, insulating particles, conductive particles, spacers for liquid crystal displays, emissive particles, hydrophobic materials, hydrophilic materials, microstructured or nanostructured layers, photoresist, metals, polymers, adhesives, binders, enzymes, and combinations thereof.

13. The donor element according to claim 1, wherein the binder of the second layer comprises a polymer.

14. The donor element according to claim 13, wherein the polymer is selected from the group consisting of phenolic resin, polyvinyl butyral resin, polyvinyl acetate, polyvinyl acetal, polyvinylidene chloride, polyacrylate, cellulosic ether and ester, nitrocellulose, acrylate and methacrylate polymer and copolymer, epoxy resin, ethylenic-unsaturated resin, polyester, polysulphone, polyimide, polyamide, polysulphide, polycarbonate, and copolymers and combinations thereof.

15. The donor element according to claim 1, wherein the transfer layer and second layer both comprise at least one identical binder.

16. The donor element according to claim 1, wherein the transfer layer and second layer both comprise at least one substantially identical binder.

17. The donor element according to claim 1, wherein the binder in the second layer has a molecular weight $M_n$ ranging from about 1000 to about 40000.

18. The donor element according to claim 17, wherein the binder in the second layer has a molecular weight $M_n$ ranging from about 1000 to about 15000.

19. The donor element according to claim 1, wherein the crosslinking agent is selected from the group consisting of polyalkylene oxides of polyalcohols, polyhydroxyl polyacrylates, acrylates of polyalcohols, polyalkylene oxide acrylates of polyalcohols, melamine formaldehydes, and combinations thereof.

20. The donor element according to claim 1, wherein the crosslinking agent is present in amounts ranging from 4% to 25% solids, based on the total solids of the layer.

21. The donor element according to claim 20, wherein the crosslinking agent is present in amounts ranging from 6% to 20% solids, based on the total solids of the layer.

22. The donor element according to claim 21, wherein the crosslinking agent is present in amounts ranging from 10% to 15% solids, based on the total solids of the layer.

23. An imaged assemblage comprising:

(1) a receiver element; and (2) a first imaged pattern disposed on the receiver element and having a height $H_1$ above the receiver element, comprising:

(a) a second layer containing a crosslinking agent and a binder but substantially no pigment; and (b) a first transfer layer containing a pigment, wherein the transfer layer is disposed between the receiver element and the second layer.

24. The imaged assemblage according to claim 23, wherein the receiver element is selected from the group consisting of glass, film, plastic, paper, metal, and combinations thereof.

25. The imaged assemblage according to claim 23, wherein the binder is crosslinked.

26. The imaged assemblage according to claim 23, further comprising a conductive layer contacting the second layer opposite the first transfer layer.

27. The imaged assemblage according to claim 23, further comprising:

(3) a second imaged pattern disposed on the receiver element and having a height $H_2$ above the receiver element, comprising:

(a) a third layer containing a binder but substantially no pigment; and (b) a second transfer layer containing a pigment different from the pigment in the first transfer layer, wherein the second transfer layer is disposed between the receiving substrate and the third layer;

wherein $H_1$ and $H_2$ have a height differential of less than 0.5 microns.

28. The imaged assemblage according to claim 27, wherein a conductive layer contacts the first imaged pattern and the second imaged pattern opposite the receiver element.

29. The imaged assemblage according to claim 27, wherein the height differential is less than 0.2 microns.

30. The imaged assemblage according to claim 27, wherein the height differential is less than 0.1 microns.

31. A color filter comprising the imaged assemblage according to claim 27.

32. A method of thermally transferring a transfer layer of a donor element comprising in order:

(1) forming an imageable assemblage comprising a receiver element and a donor element, the donor element comprising:

(a) a support layer and a transfer layer supported by the support layer, where the transfer layer comprises a pigment and is disposed between the support layer and the receiver element; and (b) a second layer disposed between the support layer and the transfer layer, the second layer comprising a crosslinking agent and a binder but substantially no pigment;

(2) imagewise exposing the imageable assemblage to light wherein the second layer is imagewise transferred substantially from the donor element to the receiving element along with the transfer layer; and (3) separating the donor element and the receiving element, wherein the imaged portions of the second layer substantially remain with the receiver element together with the imaged portions of the transfer layer.

33. The method according to claim 32, further comprising:

(4) annealing the receiving element, wherein a surface of the second layer has an $R_q$ value of less than 5 nanometers.

34. The method according to claim 32, wherein the surface of the second layer has an $R_q$ value between 1 and 2 nanometers.

35. A method of imaging comprising in order:

(1) forming a first imageable assemblage comprising a receiver element and a first donor element, the first donor element comprising a first support layer and a first transfer layer supported by the first support layer, where the first transfer layer is disposed between the first support layer and the receiver element;

(2) imagewise exposing the first imageable assemblage to light wherein the first transfer layer is imagewise transferred from the first donor element to the receiver element; and (3) separating the spent first donor element and the imaged receiver element, wherein the imaged portions of the first transfer layer remain with the imaged receiver element as a first pattern having a height $H_1$;

(4) forming a second imageable assemblage comprising the imaged receiver element and a second donor element; the second donor element comprising a second support layer and a second transfer layer supported by the second support layer, where the second transfer layer is disposed between the second support layer and the side of the imaged receiver element supporting the imaged portions of the first transfer layer;

(5) imagewise exposing the second imageable assemblage to light wherein the second transfer layer is imagewise transferred from the donor element to the receiver element; and (6) separating the second donor element and the imaged receiver element, wherein the imaged portions of the second transfer layer remain with the receiver element as a second pattern having a height $H_2$;

wherein at least one of the first donor element and the second donor element comprises a sandwiched layer disposed between the support layer and the transfer layer, the sandwiched layer comprising a crosslinking agent and a binder but substantially no pigment, wherein the binder has a molecular weight $M_n$ that causes the sandwiched layer to be substantially transferred with the transfer layer when the donor element is exposed to light.

36. The method of imaging according to claim 35, wherein $H_1$ and $H_2$ differ by less than 0.2 microns.

37. The method of imaging according to claim 35, wherein $H_1$ and $H_2$ differ by less than 0.1 microns.

38. The method of imaging according to claim 35, wherein the thickness of at least one sandwiched layer on the receiver element is greater than 0.1 microns and less than 0.5 microns.

39. The method of imaging according to claim 35, wherein the first transfer layer comprises a pigment.

40. The method of imaging according to claim 35, wherein the second transfer layer comprises a pigment.

41. The method of imaging according to claim 35, wherein the first transfer layer comprises substantially no pigment, and the second transfer layer comprises substantially no pigment.

* * * * *

UNITED STATES PATENT AND TRADEMARK OFFICE

CERTIFICATE OF CORRECTION

PATENT NO. : 7,588,656 B2
APPLICATION NO. : 11/506103
DATED : September 15, 2009
INVENTOR(S) : Weed et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 520 days.

Signed and Sealed this

Twenty-first Day of September, 2010

David J. Kappos

David J. Kappos
*Director of the United States Patent and Trademark Office*